US005219209A

United States Patent [19]

Prizzi et al.

[11] Patent Number: 5,219,209

[45] Date of Patent: Jun. 15, 1993

[54] ROTATABLE CUTTING BIT INSERT

[75] Inventors: John J. Prizzi, Greensburg; Stephen P. Stiffler, New Enterprise, both of Pa.

[73] Assignee: Kennametal Inc., Latrobe, Pa.

[21] Appl. No.: 896,818

[22] Filed: Jun. 11, 1992

[51] Int. Cl.[5] ..... E21C 35/18

[52] U.S. Cl. ..... 299/86; 175/427

[58] Field of Search ..... 299/79, 86, 91; 175/427

[56] References Cited

U.S. PATENT DOCUMENTS

| | | | |
|---|---|---|---|
| 3,830,546 | 8/1974 | Kniff | 299/86 |
| 4,497,520 | 2/1985 | Ojanen | 299/86 |
| 4,725,099 | 2/1988 | Penkunas et al. | 299/86 |
| 4,865,392 | 9/1989 | Penkunas et al. | 299/86 |
| 4,911,503 | 3/1990 | Stiffler et al. | 299/79 |
| 4,911,504 | 3/1990 | Stiffler et al. | 299/91 |
| 4,938,538 | 7/1990 | Larsson et al. | 299/86 |

FOREIGN PATENT DOCUMENTS

| | | |
|---|---|---|
| 0122893 | 10/1984 | European Pat. Off. . |
| 2846744 | 4/1980 | Fed. Rep. of Germany . |
| 899916 | 1/1982 | U.S.S.R. . |

OTHER PUBLICATIONS

Multi-Metals Drawing, C-1445-7 Sep. 1973.
American Mine Tool Drawing T-104-76 Sep. 1982.
American Mine Tool Drawing T-104-13 Nov. 1982.
American Mine Tool Drawing T-104-14 Aug. 1984.
Kennametal Drawing 921-01145 Jan. 1986.
Kennametal Drawing 921-0171 Dec. 1986.
Kennametal Drawing 921-01173 Mar. 1987.

*Primary Examiner*—David J. Bagnell
*Attorney, Agent, or Firm*—John J. Prizzi; Stephen T. Belsheim

[57] ABSTRACT

A multi-portion carbide cutting insert which affixes to the forward end of a rotatable cutting bit. The cutting insert has an axially forward tip portion and a flange portion with at least four mediate portions between the tip portion and the flange portion. The first mediate portion has an included angle less than that of the second mediate portion. The second mediate portion has an included angle greater than that of the third mediate portion. The fourth mediate portion has the largest included angle.

17 Claims, 4 Drawing Sheets

ROTATABLE CUTTING BIT INSERT

BACKGROUND OF THE INVENTION

The invention pertains to rotatable cutting bits wherein a block on a driven body, such as a drum or wheel or blade, rotatably contains the cutting bit having a hard cutting insert which affixes to the forward end of the cutting bit. More specifically, the invention pertains to the shape of the hard cutting insert which affixes to such rotatable cutting bit.

Rotatable cutting bits are a consumable component of the overall apparatus used to break a substrate into a plurality pieces. For example, a road planing machine uses rotatable cutting bits which rotatably mount in blocks on a driven drum. An engine in the road planing apparatus drives the drum. The rotation of the drum causes the cutting bits to impinge upon a road surface, such as asphalt. The result is to break the asphalt into small pieces thereby preparing the roadway for resurfacing.

The typical rotatable cutting bit comprises an elongate steel bit body with an axially forward end and an axially rearward end. The cutting bit contains a means for retaining the bit in the bore of the block such as a split sleeve retainer. The block mounts on a rotatable drum driven by the road planing machine. A hard cutting insert, typically made from a cemented tungsten carbide (WC-Co alloy) having a cobalt content ranging from about 5 to about 13 weight percent, affixes to the forward end of the cutting bit. Typically, one brazes the hard cutting insert to the steel bit body.

The hard cutting insert is the component of the cutting bit that first impinges upon the substrate. Thus, there has been an interest in the shape of the hard cutting insert, and the influence the shape of the hard cutting insert has on the performance of the cutting bit.

Because of the importance of conserving resources, it is desirable for a hard cutting insert to minimize the volume of cemented tungsten carbide necessary to manufacture the same, and thereby conserve tungsten and cobalt, without negatively impacting on its performance characteristics.

One early cutting insert has a conical tip portion which joins to a cylindrical portion. The cylindrical portion mounts in a cylindrical bore at the axially forward end of the steel bit body. U.S. Pat. No. 3,830,546 to Kniff shows one example of such a hard cutting insert.

Another early cutting insert has coaxial and integral portions comprising a conical tip portion, a frusto-conical mediate portion which is axially rearward of the tip portion, a flange portion which is axially rearward of the mediate portion and a portion which mounts in a socket in the axially forward end of the steel bit body. One example of this style of cutting insert is found in German Offenlengungsshrift No 2846744. Another example of this basic style of cutting insert is the model C-1445-7 by Multi-Metals, a business unit of Vermont American, of Louisville, Ky., wherein there is small fillet and/or a manufacturing flat, between the cylindrical base portion and the frusto-conical inter-mediate portion. Another example of a cutting insert similar to the Multi-Metals insert, at least to the extent that there is a fillet between the frusto-conical section and the base section, is the T-104-76 cutting insert made by American Mine Tool, a division of GTE Valenite Corporation, having facilities in Bristol, Va. and Madisonville, Ky.

Another early style of cutting insert has a conical tip portion, a frusto-conical portion axially rearward of the tip portion, an arcuate portion axially rearward of the frusto-conical portion, a flange portion axially rearward of the arcuate portion, and a valve seat portion axially rearward of the flange portion. The cutting insert mounts at the valve seat portion into a corresponding socket in the forward end of the steel bit body. One example of this style of cutting insert is the Kennametal tip style 921-01135 found at one time in Kennametal C-3MLR cutting bits.

Another early style of cutting insert has a conical tip section, a frusto-conical section axially rearward of the tip section, an arcuate section axially rearward of the mediate section, and a cylindrical base section axially rearward of the mediate section. The cutting insert mounts via the base section into a socket in the forward end of the steel bit body. One example of this style of cutting insert is the T-104-13 cutting insert used in the AM722RF construction tool sold by American Mine Tool. General speaking, this cutting insert is the subject matter of U.S. Pat. No. 4,497,520 to Ojanen.

Another early cutting insert has a shape along the lines of the T-104-13 cutting insert, but further includes a small cylindrical section between the tip section and the frusto-conical section. One example of this style of cutting insert is the T-104-14 cutting insert as used in the AM722RF construction tool sold by American Mine Tool. Generally speaking, this insert is the subject matter of U.S. Pat. Nos. 4,725;099 and 4,865,392 to Penkunas et al.

Another early cutting insert has a conical tip section, a cylindrical section axially rearward of the tip portion, an arcuate section axially rearward of the cylindrical portion, a flange section axially rearward of the arcuate portion and a section by which the cutting insert mounts in a socket in the steel bit body. One example of this cutting insert is shown by U.S. Pat. No. 4,938,538 to Larsson et al. and European Patent No. 0 122 893 to Larsson et al.

Another example of an earlier cutting insert has a conical tip portion, a single arcuate mediate portion axially rearward of the tip portion, a flange portion axially rearward of the arcuate portion, and a valve seat portion axially rearward of the flange portion. The valve seat portion mounts in a socket found in the forward end of the steel bit body. Kennametal Drawing Nos. 921-01171 and 921-01173 each show this style of cutting insert which was at one time used in some Kennametal construction tools.

U.S. Pat. Nos. 4,911,503 and 4,911,504 to Stiffler et al., assigned to the assignee of the present application, show a cutting insert with a conical tip portion and a cylindrical flange portion which join together via a bell-shaped intermediate portion. Three concave surfaces, each of a different radius, blend together to form the bell-shaped surface.

Soviet Author's Certificate No 899,916 shows a hard carbide tip which mounts in a steel body. The hard insert has a conical tip section, a cylindrical mediate section integral with and axially rearward of the tip section. A large diameter cylindrical flange section is integral with and axially rearward of the mediate section. A radius joins the mediate section with the flange section. A second cylindrical section is integral with and axially rearward of the large diameter flange portion. A bore in the steel body receives the second cylindrical section so as to mount the carbide tip to the steel body.

SUMMARY OF THE INVENTION

It is an object of the invention to provide an improved rotatable cutting bit with a hard cutting insert.

It is another object of the invention to provide an improved cutting bit wherein the shape of the cutting insert contributes to the improved performance of the cutting bit.

It is still another object of the invention to provide an improved cutting bit wherein the shape of the cutting insert helps conserve tungsten and cobalt, which are valuable resources.

In one form thereof, the invention is a cutting insert made from a hard material wherein the insert comprises an axially forward tip portion of a general conical shape, a first mediate portion integral with and axially rearward of the tip portion, a second mediate portion integral with and axially rearward of the first mediate portion, a third mediate portion integral with and axially rearward of the second mediate portion, a fourth mediate portion integral with and axially rearward of the third mediate portion, and a flange portion integral with and axially rearward of the fourth mediate portion.

Preferably, the first mediate portion has a transverse dimension at its joinder with the tip portion that is less than or equal to the transverse dimension at its joinder with the second mediate portion. The second mediate portion has a lesser transverse dimension at its joinder with the first mediate portion than at its joinder with the third mediate portion. The third mediate portion has a transverse dimension at its joinder with the second mediate portion that is less than or equal to the transverse dimension with its joinder with the fourth mediate portion. The fourth mediate portion has a lesser transverse dimension at its joinder with the third mediate portion than at its joinder with the flange portion. The flange portion is of a generally cylindrical shape.

In another form thereof, the invention is a rotatable construction bit comprising an elongate bit body with opposite forward and rearward ends. A cutting insert of a hard material is affixed to the bit body at the forward end thereof.

The cutting insert includes an axially forward tip portion of a general conical shape. The cutting insert further includes a first mediate portion integral with and axially rearward of the tip portion, and having a first included angle of taper greater than or equal to 0°. A second frusto-conical portion is integral with and axially rearward of the first mediate portion, and has a second included angle of taper. The second included angle of taper is greater than the first included angle of taper.

The cutting insert also includes a third mediate portion that is integral with and axially rearward of the second mediate portion. The third mediate portion has a third included angle of taper greater than or equal to 0°. The third angle of taper is less than the second included angle of taper. The cutting insert also includes a fourth frusto-conical portion that is integral with and axially rearward of the third mediate portion. The fourth frusto-conical portion has a fourth included angle of taper. The cutting insert further includes a flange portion integral with and axially rearward of the fourth frusto-conical portion. The flange is of a generally cylindrical shape.

These and other aspects of the present invention will become more apparent upon review of the drawings, which are briefly described below in conjunction with the detailed description of specific embodiments of the invention.

BRIEF DESCRIPTION OF THE DRAWINGS

Applicants now provide a brief description of the drawings which form a part of this patent application.

DETAILED DESCRIPTION OF SPECIFIC EMBODIMENTS

Figure 1:
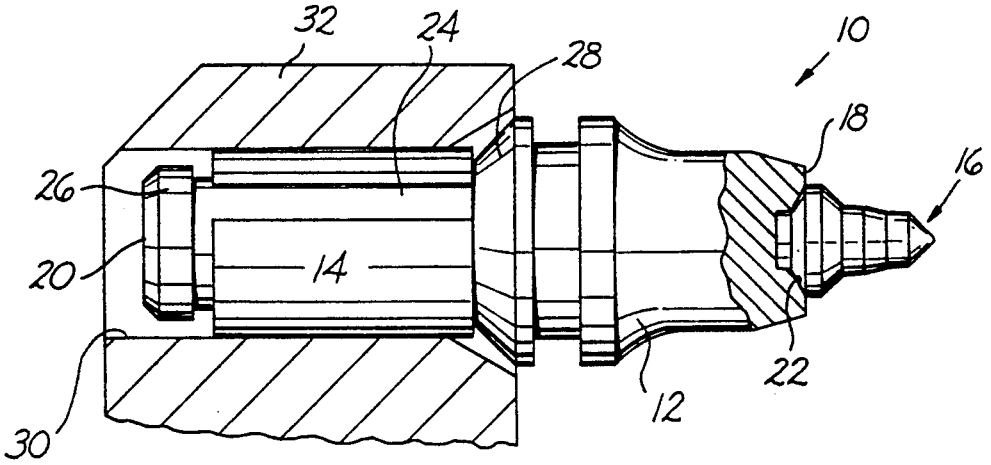
FIG. 1 is a side view of the rotatable cutting bit of the invention rotatably mounted in the bore of a block wherein a portion of the steel bit body is removed to show the attachment of the hard cutting insert to the cutting bit body.

Referring to FIG. 1, wherein FIG. 1 illustrates one specific embodiment of the rotatable cutting bit 10 of the present invention. Cutting bit 10 comprises three basic components; namely, an elongate steel body 12, a retainer sleeve 14 such as described in U.S. Pat. No. 4,201,421 to Den Besten et al., and a hard cutting insert 16.

The material for the hard cutting insert is typically a cemented tungsten carbide which is an alloy of tungsten carbide and cobalt. The cemented carbide tip may be composed of anyone of the standard tungsten carbide-cobalt compositions conventionally used for construction applications. The specific grade of cemented carbide depends upon the particular application to which one puts the tool. The cobalt content ranges from about 5 to about 13 weight percent with the balance being tungsten carbide, except for impurities. For rotatable cutting tools used in road planing, it may be desirable to use a standard tungsten carbide grade containing between about 5.4 to about 6.0 weight percent cobalt (balance WC) and having a Rockwell A hardness between about 88.2 and about 88.8.

The steel bit body 12 has an axially forward end 18 and an axially rearward end 20. The forward end 18 preferably contains a socket 22 therein, and it is at this location that the hard cutting insert 16 affixes to the bit body 12.

In regard to all of the specific embodiments, it is preferred that a high temperature braze material be used in joining the cemented carbide insert to the steel body so that braze joint strength is maintained over a wide temperature range. The preferred braze material is a HIGH TEMP 080 manufactured and sold by Handy & Harman, Inc., 859 Third Avenue, New York, N.Y. 10022. The nominal composition (weight percent) and the physical properties of the Handy & Harman HIGH TEMP 080 braze alloy (according to the pertinent product literature from Handy & Harman, U.S. Pat. No. 4,631,171 covers the HIGH TEMP 080 braze alloy) are set forth below:

| | | | |
|---|---|---|---|
| NOMINAL COMPOSITION | Copper | 54.85% | ±1.0 |
| | Zinc | 25.0 | ±2.0 |
| | Nickel | 8.0 | ±0.5 |
| | Manganese | 12.0 | ±0.5 |
| | Silicon | 0.15 | ±0.5 |
| | Other Elements | 0.15 | |
| PHYSICAL PROPERTIES: | Color | Light Yellow | |
| | Solidus | 1575° F. (855° C.) | |
| | Liquidus (Flow Point) | 1675° F. (915° C.) | |
| | Specific Gravity | 8.03 | |
| | Density (lbs/cu. in.) | .290 | |
| | Electrical Conductivity (% I.A.C.S.) | 6.0 | |
| | Electrical Resistivity (Microhm-cm.) | 28.6 | |
| | Recommend Brazing Temperature Range | 1675-1875° F. (915-1025° C.) | |

Another braze alloy which applicants consider to be acceptable is the HANDY HI-TEMP 548 braze alloy. HANDY HI-TEMP 548 alloy is composed of 55±1.0 w/o (weight percent) Cu, 6±0.5 w/o Ni, 4±0.5 w/o Mn, 0.15±0.05 w/o Si, with the balance zinc and 0.50 w/o maximum total impurities. Further, information on HANDY HI-TEMP 548 can be found in Handy & Harmon Technical Data Sheet No. D-74 available from Handy & Harmon, Inc.

The bit body 12 has a reduced diameter section 24 near the rearward end 20 thereof. The enlarged diameter portions 26, 28, which define the ends of the reduced diameter portion 24, maintain the retainer sleeve 14 captive on the bit body 12. Because the reduced diameter portion 24 is of a diameter smaller than the inside diameter of the retainer sleeve 14, the retainer sleeve 14 is free to rotate relative to the bit body 12.

The bit body 12 mounts in the bore 30 of a block 32 which affixes to a driven member (not illustrated) such as a drum of a road planing machine. Once the bit 10 is within the volume of bore 30, the retainer sleeve 14 is resiliently compressed radially inwardly and thereby frictionally engages the wall of the bore 30. The bit 10 mounts to the block 32 in such a fashion so the it is free to rotate within the bore 30 relative to the block 32.

Figure 2:
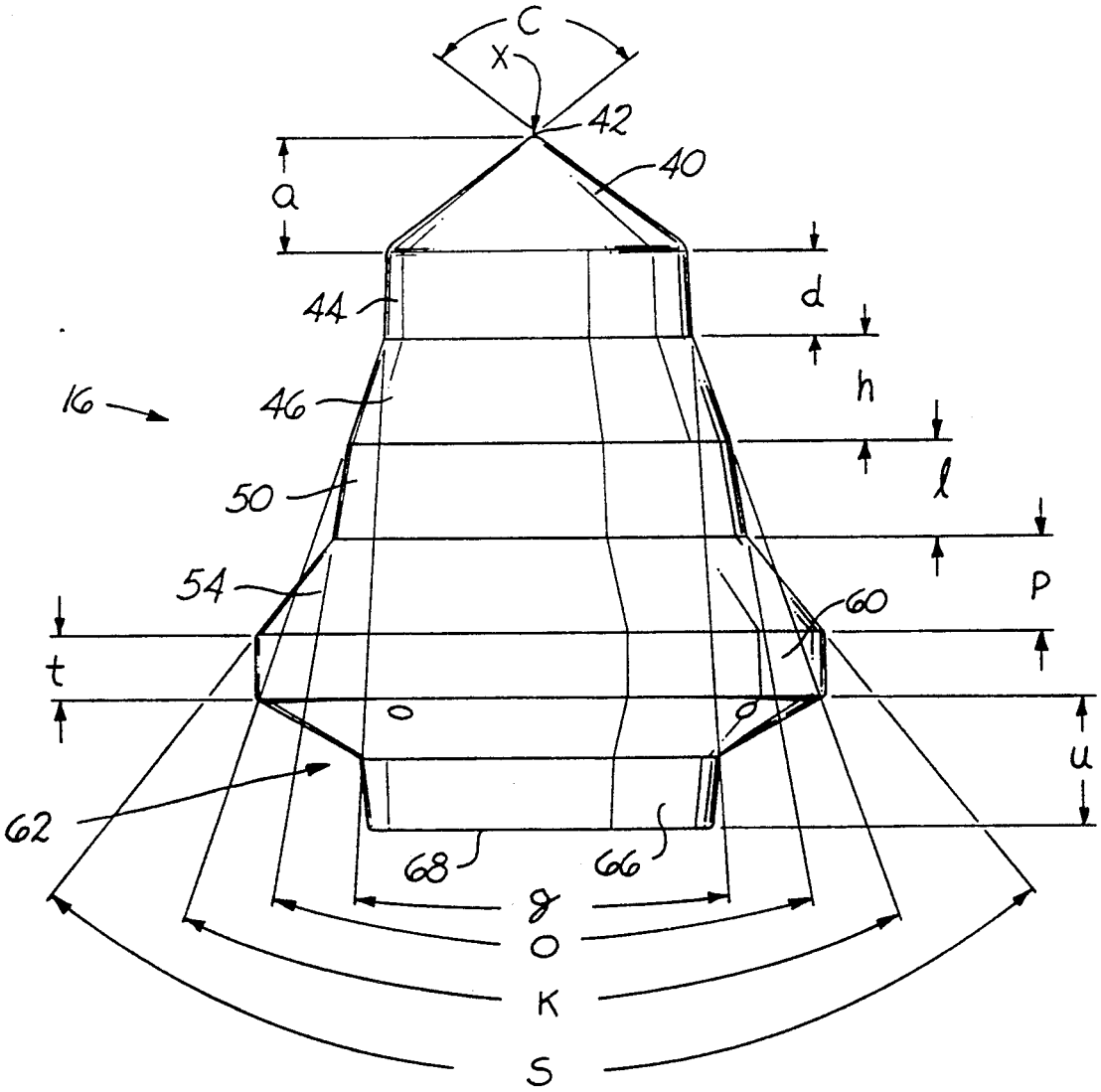
FIG. 2 is a side view of one specific embodiment of the hard cutting insert of the invention.
Figure 3:
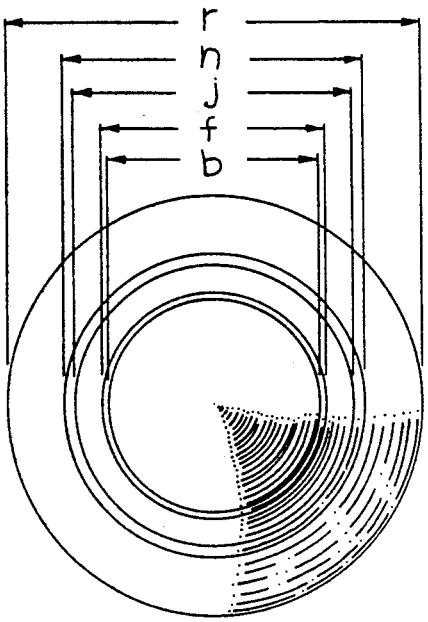
FIG. 3 is a top view of the hard cutting insert of FIG. 2.
Figure 4:
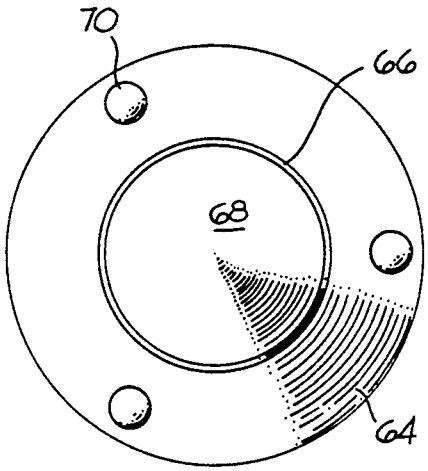
FIG. 4 is a bottom view of the hard cutting insert of FIG. 2.

Referring to FIGS. 2-4 the hard cutting insert 16 includes a plurality of integral portions in coaxial alignment. These portions include a tip portion 40 which is of a generally conical shape. The tip portion 40 terminates at its axially forward end in a semi-spherical portion 42. The radius "x" of the semi-spherical portion 42 is equal to about 0.06 inches. Tip portion 40 increases in transverse diameter in a direction axially rearwardly from the termination point. In the specific embodiment, tip portion 40 has an axial length "a" of about 0.130 inches, a maximum diameter "b" of about 0.310 inches, and an included angle "c" of about 90°.

The hard cutting insert 16 further includes a first mediate portion 44, which is integral with the tip portion 40. The first mediate portion 44 is axially rearward of the tip portion 40. First mediate portion 44 increases in transverse dimension in a direction axially rearwardly from the joinder with the tip portion 40. In the specific embodiment, the shape of the surface of the first mediate portion is generally frusto-conical. First mediate portion 44 has an axial length "d" of about 0.109 inches. First mediate portion 44 has a maximum diameter "f" of about 0.329 inches. The minimum diameter of the first mediate portion 44 is equal to the maximum diameter b of the tip portion 40. First mediate portion 44 has an included angle "g" of about 10°.

The hard cutting insert 16 further includes a second mediate portion 46, which is integral with the first mediate portion 44. The second mediate portion 46 increases in transverse dimension in a direction axially rearwardly from the joinder with the first mediate portion 44. In the specific embodiment, the shape of the second mediate portion 46 is generally frusto-conical. Second mediate portion 46 has an axial length "h" of about 0.113 inches. Second mediate portion 46 has a maximum diameter "j" of about 0.407 inches. The minimum diameter of the second mediate portion 46 is equal to the maximum diameter f of the first mediate portion 44. Second mediate portion 46 has an included angle "k" of about 30°.

The hard cutting insert 16 further includes a third mediate portion 50, which is integral with the second mediate portion 46. The third mediate portion 50 is axially rearward of the second mediate portion 46. In this specific embodiment, the third mediate portion 50 increases in transverse dimension in a direction axially rearwardly from the joinder with the second mediate portion 46. In the specific embodiment, the shape of the surface of the third mediate portion 50 is generally frusto-conical. Third mediate portion 50 has an axial length "l" of about 0.109 inches. Third mediate portion 50 has a maximum diameter "n" of about 0.447 inches. The minimum diameter of the third mediate portion 50 is equal to the maximum diameter j of the second mediate portion 46. Third mediate portion 50 has an included angle "o" of about 21°.

The cutting insert 16 further includes a fourth mediate portion 54, which is integral With the third mediate portion 50. The fourth mediate portion 54 increases in transverse dimension in a direction axially rearwardly from the joinder with the third mediate portion 50. In the specific embodiment, the shape of the fourth mediate portion 54 is generally frusto-conical. Fourth mediate portion 54 has an axial length "p" of about 0.173 inches. Fourth mediate portion 54 has a maximum diameter "r" of about 0.625 inches. The minimum diameter of the fourth mediate portion 54 is equal to the maximum diameter of the third mediate portion 50. Fourth mediate portion 56 has an included angle "s" of about 78°.

The cutting insert 16 further includes a flange portion 60 which is of a generally cylindrical shape. Flange portion 60 is integral with and axially rearward of fourth mediate portion 54. The axial length "t" of flange portion 60 is equal to about 0.070 inches. The diameter of the flange portion 60 is equal to the maximum diameter r of the fourth mediate portion 54.

The cutting insert 16 also includes a valve seat portion 62. Valve seat portion 62 has an axially forward frusto-conical portion 64 which is integral with an axially rearward frusto-conical portion 66. Axially rearward frusto-conical portion 66 terminates in a flat surface 68. The axial length "u" of the valve seat portion 62 is about 0.154 inches.

The surface of the axially forward frusto-conical section 64 presents a trio of circumferentially equispaced bumps 70. These bumps 70 provide for the correct centering of the hard cutting insert 16 in the socket 22 and for a substantially uniform thickness of the braze joint therebetween. In this regard, the cutting insert affixes into the socket via brazing by known techniques whereby there is a braze joint between the surface of the axially forward frusto-conical section 64 and the corresponding surface of the socket. U.S. Pat. No. 4,981,328 to Stiffler et al., assigned to the assignee of the present application, describes the function and advantages of the bumps 70 in more detail.

Figure 5:
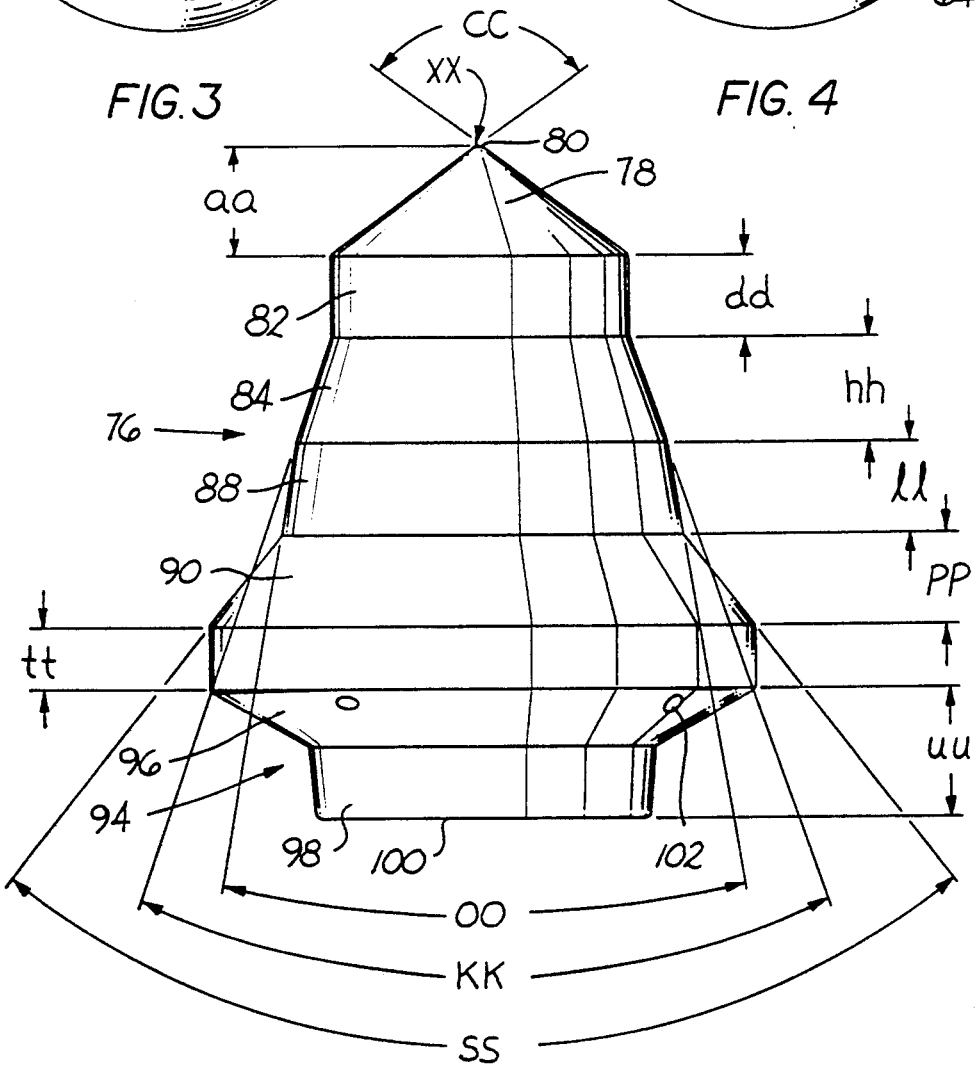
FIG. 5 is a side view of a second specific embodiment of the hard cutting insert of the invention.
Figure 6:
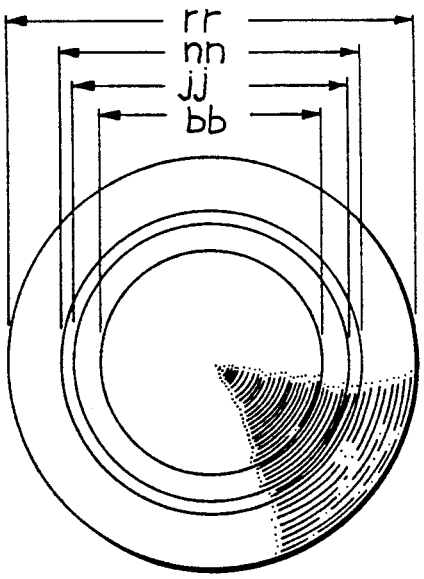
FIG. 6 is a top view of the hard cutting insert of FIG. 5.

Referring to FIGS. 5 and 6, the second specific embodiment of the hard cutting insert 76 includes a plurality of integral portions in coaxial alignment. These portions include a tip portion 78 which is of a generally conical shape. The tip portion 78 terminates at its axially forward end in a semi-spherical portion 80. The radius "xx" of the semi-spherical portion 80 is equal to about 0.125 inches. Tip portion 78 increases in transverse diameter in a direction axially rearwardly from the termination point. In the specific embodiment, the shape of the surface of the tip portion 78 is generally conical. Tip portion 78 has an axial length "aa" of about 0.193 inches, a maximum diameter "bb" of about 0.440 inches, and an included angle "cc" of about 80°.

The cutting insert 76 further includes a first mediate portion 82, which is integral with the tip portion 78. The first mediate portion 82 is axially rearward of the tip portion 78. First mediate portion 82 is of cylindrical shape. First mediate portion 82 has an axial length "dd" of about 0.115 inches. The diameter of the first mediate portion 82 is equal to the maximum diameter of the tip portion 78.

The hard cutting insert 76 further includes a second mediate portion 84, which is integral with the first mediate portion 82. The second mediate portion 84 increases in transverse dimension in a direction axially rearwardly from the joinder with the first mediate portion 82. In the specific embodiment, the shape of the second mediate portion 84 is generally frusto-conical. Second mediate portion 84 has an axial length "hh" of about 0.116 inches. Second mediate portion 84 has a maximum diameter "jj" of about 0.515 inches. The minimum diameter of the second mediate portion 84 is equal to the diameter of the first mediate portion 82. Second mediate portion 84 has an included angle "kk" of about 36°.

The hard cutting insert 76 further includes a third mediate portion 88, which is integral with the second mediate portion 84. The third mediate portion 88 is axially rearward of the second mediate portion 84. In this specific embodiment, the third mediate portion 88 increases in transverse dimension in a direction axially rearwardly from the joinder with the second mediate portion 84. In the specific embodiment, the shape of the surface of the third mediate portion 84 is generally frusto-conical. Third mediate portion 84 has an axial length "ll" of about 0.111 inches. Third mediate portion 84 has a maximum diameter "nn" of about 0.578 inches. The minimum diameter of the third mediate portion 88 is equal to the maximum diameter of the second mediate portion. Third mediate portion 84 has an included angle "oo" of about 32°.

The hard cutting insert 76 further includes a fourth mediate portion 90, which is integral with the third mediate portion 88. The fourth mediate portion 90 increases in transverse dimension in a direction axially rearwardly from the joinder with the third mediate portion 88. In the specific embodiment, the shape of the fourth mediate portion 90 is generally frusto-conical. Fourth mediate portion 90 has an axial length "pp" of about 0.089 inches. Fourth mediate portion 90 has a maximum diameter "rr" of about 0.750 inches. The minimum diameter of the fourth mediate portion is equal to the maximum diameter of the third mediate portion. Fourth mediate portion 90 has an included angle "ss" of about 88°.

The hard cutting insert 76 further includes a flange portion 92 which is of a generally cylindrical shape. Flange portion 92 is integral with and axially rearward of fourth mediate portion 90. The axial length "tt" of flange portion 92 is about 0.070 inches.

The hard cutting insert 76 also includes a valve seat portion 94. Valve seat portion 94 has an axially forward frusto-conical portion 96 which is integral with an axially rearward frusto-conical portion 98. Axially rearward frusto-conical portion 98 terminates in a flat surface 100. The axial length "uu" of the valve seat portion 94 is about 0.188 inches.

The surface of the axially forward frusto-conical portion 96 presents a trio of circumferentially equispaced bumps 102. These bumps 102 provide for the correct centering of the hard cutting insert 76 in the socket 22 and for a substantially uniform thickness of the braze joint. In this regard, the cutting insert 76 affixes into the socket 22 via brazing whereby there is a braze joint between the surface of the axially forward frusto-conical section and the corresponding surface of the socket. U.S. Pat. No. 4,981,328 to Stiffler et al. describes the function of bumps like bumps 102 in more detail.

Figure 7:
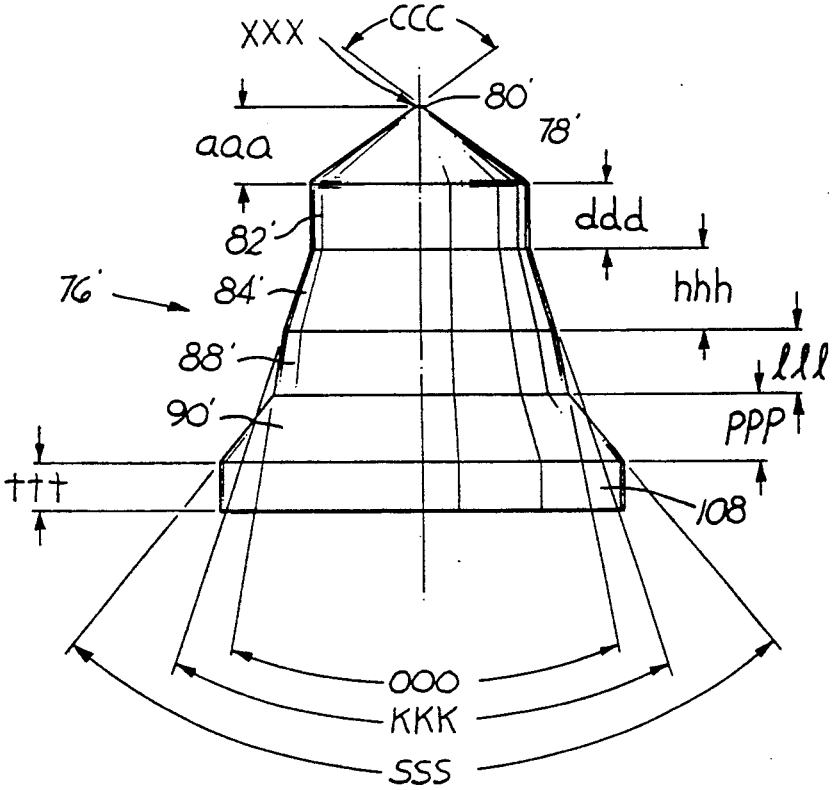
FIG. 7 is a side view of a third specific embodiment of the hard cutting insert of the invention.
Figure 8:
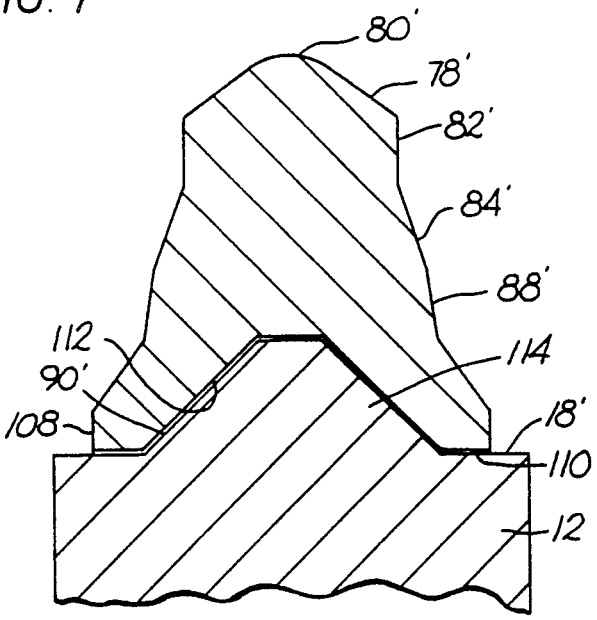
FIG. 8 is a cross-sectional view of the cutting insert of FIG. 7 further including a portion of the steel body of the cutting bit to illustrate the attachment of the cutting insert to the steel shank.
Figure 7A:
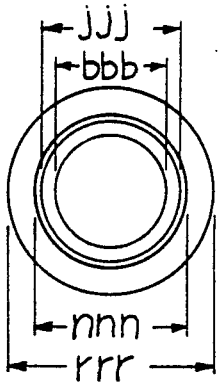
FIG. 7A is a top of the hard cutting insert of FIG. 7.

Referring to FIGS. 7 and 8, a third specific embodiment of the hard cutting insert 76' is shown by these drawings. The third specific embodiment of the hard cutting insert 76' includes a plurality of integral portions in coaxial alignment. These portions include a tip portion 78' which is of a generally conical shape. The tip portion 78' terminates at its axially forward end in a semi-spherical portion 80'. The radius "xxx" of the semi-spherical portion 80' is equal to about 0.125 inches. Tip portion 78' increases in transverse diameter in a direction axially rearwardly from the termination point. In the specific embodiment, the shape of the surface of the tip portion 78' is generally conical. Tip portion 78 has an axial length "aaa" of about 0.160 inches, a maximum diameter "bbb" of about 0.385 inches, and an included angle "ccc" of about 80°.

The cutting insert 76' further includes a first mediate portion 82', which is integral with the tip portion 78'. The first mediate portion 82' is axially rearward of the tip portion 78'. First mediate portion 82' is of cylindrical shape. First mediate portion 82' has an axial length "ddd" of about 0.116 inches. The diameter of the first mediate portion 82' is equal to the maximum diameter of the tip portion 78'.

The hard cutting insert 76' further includes a second mediate portion 84', which is integral with the first mediate portion 82'. The second mediate portion 84' increases in transverse dimension in a direction axially rearwardly from the joinder with the first mediate portion 82'. In the specific embodiment, the shape of the second mediate portion 84' is generally frusto-conical. Second mediate portion 84 has an axial length "hhh" of about 0.115 inches. Second mediate portion 84' has a maximum diameter "jjj" of about 0.460 inches. The minimum diameter of the second mediate portion 84' is equal to the diameter of the first mediate portion 82'. Second mediate portion 84' has an included angle "kkk" of about 36°.

The hard cutting insert 76' further includes a third mediate portion 88', which is integral with the second mediate portion 84'. The third mediate portion 88' is axially rearward of the second mediate portion 84'. In this specific embodiment, the third mediate portion 88' increases in transverse dimension in a direction axially rearwardly from the joinder with the second mediate portion 84'. In the specific embodiment, the shape of the surface of the third mediate portion 88' is generally frusto-conical. Third mediate portion 88' has an axial length "lll" of about 0.116 inches. Third mediate portion 88' has a maximum diameter "nnn" of about 0.527 inches. The minimum diameter of the third mediate portion 88' is equal to the maximum diameter of the second mediate portion. Third mediate portion 84' has an included angle "ooo" of about 32°.

The hard cutting insert 76' further includes a fourth mediate portion 90', which is integral with the third mediate portion 88'. The fourth mediate portion 90' increases in transverse dimension in a direction axially rearwardly from the joinder with the third mediate portion 88'. In the specific embodiment, the shape of the fourth mediate portion 90' is generally frusto-conical. Fourth mediate portion 90' has an axial length "ppp" of about 0.116 inches. Fourth mediate portion 90' has a maximum diameter "rrr" of about 0.750 inches. The minimum diameter of the fourth mediate portion is equal to the maximum diameter of the third mediate portion. Fourth mediate portion 90' has an included angle "sss" of about 88°.

The hard cutting insert 76' includes an axially rearward cylindrical portion 108 that is integral with and axially rearward of the fourth mediate portion 90'. The axial length "ttt" of cylindrical portion 108 is equal to about 0.070 inches. Cylindrical portion 108 has a bottom surface 110. A recess 112 is in the bottom surface 110 of the hard cutting insert 76'.

Recess 112 has a configuration which receives a protrusion 114 at the axially forward end 18' of the steel body 12'. The hard cutting insert 76' mounts to the protrusion 114 via brazing. U.S. Pat. Nos. 4,911,503 and 4,911,504 to Stiffler et al. describe in more detail the attachment of a hard cutting insert with a recess to a bit body with a protrusion. These descriptions are incorporated by reference herein.

Although the third mediate portion in each of the three specific embodiments is of a frusto-conical shape, it is within the scope of the invention for the third mediate portion to be of a generally cylindrical shape.

In regard to the manufacture of the hard cutting insert, all three specific embodiments of the hard cutting insert are made in essentially the same way. For exemplary purposes, the written description describes the manufacture of hard cutting insert 76.

One makes the hard cutting insert 76 through powder metallurgical techniques wherein loose powders of tungsten carbide cobalt, and a pressing lubricant are in a die cavity. The punch-die arrangement then presses the loose powder into a selected configuration which those skilled in the art call a green compact. The green compact undergoes sintering to remove the lubricant and consolidate the tungsten carbide and cobalt to form the as-sintered part which comprises a dense tungsten carbide-cobalt alloy of a particular shape.

Figure 9A:
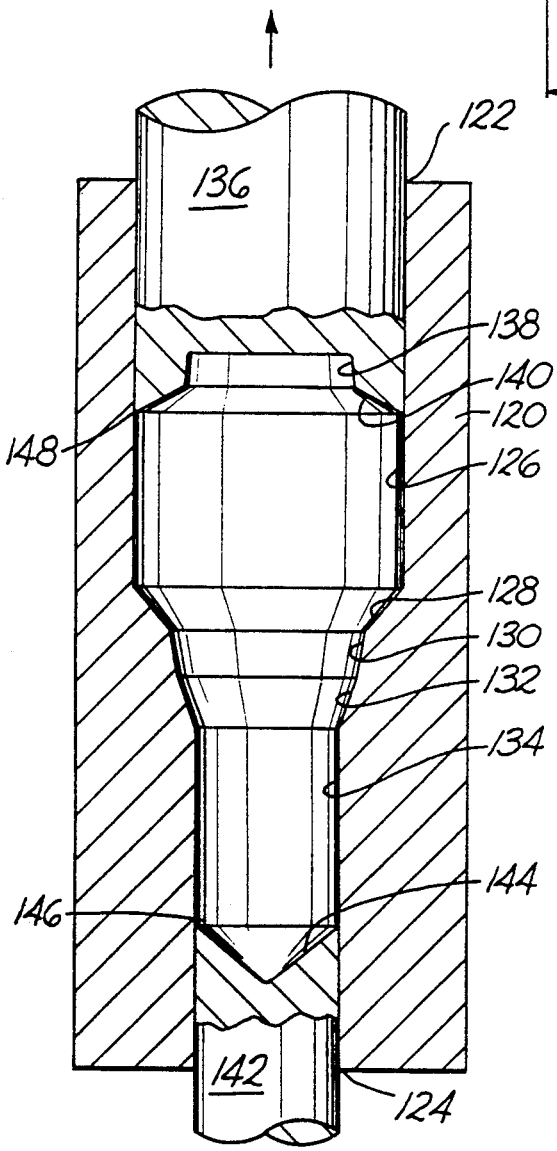
FIG. 9A is a view of the die case and the top and punches used to press the cutting insert of FIG. 5 wherein the punches are in a position away from the final pressing position.

Referring to the manufacture of the second specific embodiment of the hard insert 76, FIG. 9A shows the die case 120 which has a top end 122 and a bottom end 124 which is opposite from the top end 122. The die case 120 includes a central die cavity which has a cylindrical configuration 126 near the top end 122. The die cavity further includes three frusto-conical configurations 128, 130, and 132 which correspond to form the fourth mediate portion 90, the third mediate portion 88 and the second mediate portion 84 of the hard cutting insert 76, respectively. A cylindrical configuration 134 is below the frusto-conical configurations, and forms the cylindrical portion 82 of the hard cutting insert 76.

The top punch 136 includes a recess therein which has two frusto-conical configurations 138 and 140 which form the frusto-conical portions 98 and 96, respectively, of the valve seat 94. The bottom punch 142 has a conical recess 144 which forms the conical tip portion 78 of the cutting insert 76. The outside edge of the lower punch 142 includes a small manufacturing flat 146 so that the punch does not terminate in a feather edge. The same is true for the upper punch 136 which has a manufacturing flat 148 at the outside edge thereof.

Figure 9B:
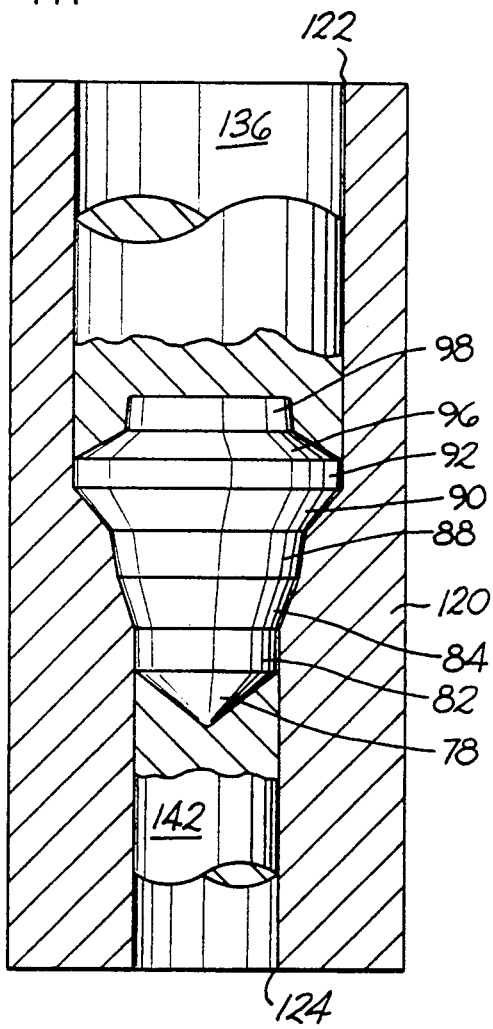
FIG. 9B is a view of the die case and the top and bottom punches of FIG. 9A wherein the punches are in their pressing position in which they form the green compact from loose powder.

To form a green compact of the cutting insert, loose powder of tungsten carbide, cobalt and a pressing lubricant is deposited within the die cavity. At this point in the process, the punches 136 and 142 are apart as shown in FIG. 9A. Once the correct volume of loose powder is within the die cavity, the punches move toward each other so as to press the loose powder into a green compact. FIG. 9B shows the point at which the punches form the green compact. Because of the fact that the punches move toward each other to compact the loose powder, the green compact achieves a relatively uniform density. The existence of a green compact of a relatively uniform density facilitates the reduction of cracks in the as-sintered hard cutting insert, which is a highly desirable result.

In operation, the cutting bit 10 rotates about its central longitudinal axis while the drum rotates to drive the cutting bit 12 into a substrate such as an asphalt road surface. The longitudinal axis of the drum is transverse to the longitudinal axis of the cutting bit. The hard cutting insert (16, 76, 76') is the component of the cutting bit 10 which actually first impinges upon the substrate. Applicants now provide a description of the operation of the specific embodiments of the hard cutting inserts below.

Referring to the first specific embodiment of the hard cutting insert 16, the tip portion 40 first impinges upon the substrate. As the cutting bit drives further into the substrate, the first mediate portion 44, the second mediate portion 46, the third mediate portion 50, the fourth mediate portion 54 and the flange 60 each interact with the substrate or pieces thereof.

As the hard cutting insert 16 of each cutting bit continues to impact the substrate upon each rotation of the drum, the cutting insert 16 experiences wear. The nature of the wear is such that the tip portion 40 will wear away so that the part of the hard cutting insert 16 which first impacts the substrate becomes the first mediate portion 44. The first mediate portion 44 has an included angle g equal to about 10°. The second mediate portion 46 increases in its transverse dimension at an angle k of 30°. This angle is greater than the included angle g, and therefore, provides a continual increase in the volume of carbide which functions to strengthen and support the first mediate portion 44 during the cutting operation.

Once the first mediate portion wears away, the second mediate portion first impinges upon the substrate.

Once the second mediate portion has worn away and the third mediate portion first impinges the substrate.

The fourth mediate portion 54 increases at an angle s equal to about 78°, which is significantly greater than angle o of the third mediate portion. The fourth mediate portion 54 functions to support and strengthen the third mediate portion 52. At the point in time where the hard cutting insert 16 wears down to the fourth mediate portion 54, the cutting insert reaches a point where its effectiveness is substantially reduced.

Referring now to FIGS. 5 and 6, in the operation of the second specific embodiment of the hard cutting insert 76, the tip portion 78 first impinges upon the substrate. As the cutting bit 10 drives further into the substrate, the first mediate portion 82, the second mediate portion 84, the third mediate portion 88, the fourth mediate portion 90 and the flange 92 each interact with the substrate or pieces thereof.

As the hard cutting insert 76 of each cutting bit continues to impact the substrate upon each rotation of the drum, the cutting insert 76 experiences wear. The nature of the wear is such that the tip portion 78 will wear away so that the part of the hard cutting insert 76 which first impacts the substrate becomes the first mediate portion 82.

The first mediate portion 82 has a cylindrical shape. The second mediate portion 84 increases in its transverse dimension at an angle kk of 36°. This angle provides a continual increase in the volume of carbide. This continual increase in carbide functions to support and strengthen the first mediate portion during the cutting operation.

Once the first mediate portion wears away, the second mediate portion first impinges upon the substrate.

Once the second mediate portion has worn away, the third mediate portion first impinges upon the substrate. The third mediate portion 88 increases in its transverse dimension at an angle oo equal to 32°, which is less than included angle kk (36°).

The fourth mediate portion 90 increases at an angle ss, which is about 88°, which is significantly greater than angle oo (32°) of the third mediate portion. The fourth mediate portion 90 functions to support and strengthen the third mediate portion 88. At the point in time where the hard cutting insert 76 wears down to the fourth mediate portion 90, the cutting insert reaches a point where its effectiveness is substantially reduced.

The operation of the third specific embodiment is essentially the same as that of the second specific embodiment. Thus, a description of the third specific embodiment is not set forth herein since the description of the operation of the second specific embodiment will suffice for that of the third specific embodiment.

It can be seen that the present invention presents a rotatable cutting bit with a cutting insert that provides certain advantages.

The second mediate portion has an included angle greater than that of the first mediate portion, and thus, provides support and strength for the first mediate portion.

The fourth mediate portion has the largest included angle and provides support and strength for the third mediate portion, as well as the entire cutting insert during its operation.

Each one of the specific embodiments of the hard cutting insert presents a shape that conserves the volume of cemented tungsten carbide necessary to make the hard cutting insert. Thus, this invention helps conserve the valuable resources of tungsten and cobalt.

In each one of the specific embodiments, the tip portion is axially forward of and has a larger included angle than that of the first mediate portion. During operation, the tip portion with the larger included angle functions to help divert, and direct to some extent, debris away from the surface of the first mediate portion. By directing such debris away from the first mediate portion, the integrity of the first mediate portion is better maintained than in the absence of such diversion.

In each specific embodiment, the second mediate portion is axially forward of and has a larger included angle than that of the third mediate portion. During operation, the second mediate portion with the larger included angle functions to help divert, and direct to some extent, debris away from the surface of the third mediate portion. By directing such debris away from the third mediate portion, the integrity of the third mediate portion is better maintained than in the absence of such diversion.

As is well known to those of ordinary skill in the art, at the junctures of the various surfaces described on the carbide tip, rounds, chamfers, fillets and/or pressing flats may be provided, where appropriate, to assist in manufacturing and/or provide added strength to the structure.

Other specific embodiments of the invention will be apparent to those skilled in the art from a consideration of this specification or practice of the invention disclosed herein. It is intended that the specification and specific embodiments be considered as exemplary only, with the true scope and spirit of the invention being indicated by the following claims.

What is claimed is:

1. A cutting insert made from a hard material, wherein the insert comprises:

an axially forward tip portion of a general conical shape;

a first mediate portion being integral with and axially rearward of said tip portion, a second mediate portion being integral with and axially rearward of said first mediate portion, a third mediate portion being integral with and axially rearward of said second mediate portion, a fourth mediate portion being integral with and axially rearward of said third mediate portion, a flange portion being integral with and axially rearward of said fourth mediate portion;

said first mediate portion having a transverse dimension at its joinder with the tip portion that is less than the transverse dimension of the second mediate portion at its joinder with the third mediate portion;

said second mediate portion having a lesser transverse dimension at the joinder with the first mediate portion than at the joinder with the third mediate portion;

said third mediate portion having a transverse dimension at its joinder with the second mediate portion that is less than the transverse dimension of the fourth mediate portion at its joinder with the flange portion;

said fourth mediate portion having a lesser transverse dimension at the joinder with the third mediate portion than at the joinder with the flange portion; and said flange portion being of a generally cylindrical shape.

2. The cutting insert of claim 1 wherein said first mediate portion continually increases in transverse dimension at a first included angle from its joinder with the tip portion to its joinder with the second mediate portion.

3. The cutting insert of claim 2 wherein said second mediate portion continually increases in transverse dimension at a second included angle from its joinder with the first mediate portion to its joinder with the third mediate portion, said second included angle being greater than said first included angle.

4. The cutting insert of claim 3 wherein said third mediate portion continually increases in transverse dimension at a third included angle from its joinder with the second mediate portion to its joinder with the fourth mediate portion, said third included angle being less than said second included angle.

5. The cutting insert of claim 4 wherein said fourth mediate portion continually increases in transverse dimension at a fourth included angle from its joinder with the third mediate portion to its joinder with the flange portion, and said fourth included angle being greater than said third included angle.

6. The cutting insert of claim 5 wherein said second included angle is greater than the sum of said first and third included angles.

7. The cutting insert of claim 6 wherein said fourth included angle is greater than the sum of said first, second and third included angles.

8. The cutting insert of claim 7 wherein said third included angle is greater than said first included angle.

9. The cutting insert of claim 1 wherein said first mediate portion has a transverse dimension at its joinder with tip portion equal to its transverse dimension at its joinder with the second mediate portion.

10. The cutting insert of claim 1 further including a valve seat portion integral with and axially rearwardly of said flange portion.

11. The cutting insert of claim 1 wherein said flange portion has a bottom surface, and said bottom surface having a recess therein.

12. A rotatable construction bit comprising:

an elongate bit body having opposite forward and rearward ends;

a cutting insert made from a hard material being affixed to said bit body at the forward end thereof;

said cutting insert including:

an axially forward tip portion of a general conical shape;

a first mediate portion being integral with and axially rearward of said tip portion; said first mediate portion having a first included angle of taper greater than or equal to 0°;

a second frusto-conical portion being integral with and axially rearward of said first mediate portion; said second frusto-conical portion having a second included angle of taper, said second included angle of taper being greater than said first included angle of taper;

a third mediate portion being integral with and axially rearward of said second frusto-conical portion; said third mediate portion having a third included angle of taper greater than or equal to 0°, said third included angle of taper being less than said second included angle of taper;

a fourth frusto-conical portion being integral with and axially rearward of said third frusto-conical portion, said fourth frusto-conical portion having a fourth included angle of taper; and a flange portion being integral with and axially rearward of said fourth frusto-conical portion, said flange being of a generally cylindrical shape.

13. The construction bit of claim 12 wherein the bit body contains a socket in the forward end thereof, and the cutting insert further includes a valve seat integral with and axially rearward of said flange portion, the socket has a shape that corresponds to the shape of said valve seat portion, and said valve seat portion being brazed into the socket whereby the cutting insert is affixed to the bit body.

14. The construction bit of claim 12 wherein the bit body contains a protrusion at the forward end thereof, said flange portion has a bottom surface, and a recess being in said bottom surface, said recess having a shape that corresponds to the shape of the protrusion, and said protrusion being brazed into the recess so that the cutting insert is affixed to the bit body.

15. The construction bit of claim 12 wherein said first mediate portion is of a generally cylindrical shape so that the first included angle of taper is equal to 0°.

16. The construction bit of claim 12 wherein said first mediate portion is of a generally frusto-conical shape.

17. The construction bit of claim 12 wherein said third mediate portion is of a generally frusto-conical shape.

* * * * *